US006019240A

United States Patent [19]

Legeza

[11] Patent Number: 6,019,240

[45] **Date of Patent: *Feb. 1, 2000**

[54] FIBER BOARD DRUM WITH PLASTIC CHIME ASSEMBLY

[75] Inventor: Peter Legeza, Vevay, Ind.

[73] Assignee: SST Fiber Drums, Inc., Loveland, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/845,350

[22] Filed: Apr. 25, 1997

[51] Int. Cl.[7] ..... B65D 45/34

[52] U.S. Cl. ..... 220/321; 220/319; 220/634; 220/636; 220/618; 229/5.5; 229/5.7

[58] Field of Search ..... 229/5.5, 5.7, 5.8; 220/634, 636, 321, 612, 613, 625, 628, 604, 605, 611, 618, 319; 215/372, 376, 377, 274

[56] References Cited

U.S. PATENT DOCUMENTS

| | | | |
|---|---|---|---|
| 264,099 | 9/1882 | Norton | 220/618 X |
| 534,906 | 2/1895 | McLean | 220/268 X |
| 2,311,291 | 2/1943 | Carlson | 229/5.8 |
| 2,391,774 | 12/1945 | Eggerss | 229/5.5 X |
| 2,511,481 | 6/1950 | Schneider | 229/5.7 X |
| 2,579,974 | 12/1951 | Scott et al. | 229/5.5 |
| 2,801,039 | 7/1957 | Arneson . | |
| 2,850,204 | 9/1958 | Rehrig | 220/628 X |
| 3,734,393 | 5/1973 | Stump | 229/5.5 |
| 3,910,450 | 10/1975 | Hammes | 220/613 |
| 4,182,475 | 1/1980 | Freund . | |
| 4,241,864 | 12/1980 | Kessler . | |
| 4,249,690 | 2/1981 | Held, Jr. | 229/5.5 |
| 4,252,265 | 2/1981 | Brundige et al. . | |
| 4,305,535 | 12/1981 | Brundige et al. . | |
| 4,355,759 | 10/1982 | Amberg | 229/5.5 |
| 4,560,063 | 12/1985 | Müller . | |
| 4,720,038 | 1/1988 | Shepard | 220/618 X |
| 4,762,249 | 8/1988 | Fortuna et al. | 229/5.5 X |
| 4,886,181 | 12/1989 | Haines | 220/618 X |
| 5,018,641 | 5/1991 | Carpenter, Jr. et al. | 220/634 |
| 5,129,537 | 7/1992 | Bordner et al. . | |
| 5,190,209 | 3/1993 | Gordon et al. . | |
| 5,259,526 | 11/1993 | Stolzman | 220/319 X |
| 5,263,606 | 11/1993 | Dutt et al. | 220/613 |
| 5,312,013 | 5/1994 | Bridges | 220/625 |

FOREIGN PATENT DOCUMENTS

| | | | |
|---|---|---|---|
| 101106 | 2/1965 | Denmark | 229/5.5 |

*Primary Examiner*—Stephen P. Garbe
*Assistant Examiner*—Robin A Hylton
*Attorney, Agent, or Firm*—Thompson Hine & Flory LLP

[57] ABSTRACT

A chime assembly shaped to fit on the upper opening of a drum to receive a top and a closing ring. The chime assembly comprises a top chime having a lower band with a slot shaped to receive the upper opening of a drum. The top chime has a top flange and an upper annular portion having an annular groove shaped to receive a sealing ring. The top flange comprises a substantially axially-extending wall and a substantially radially extending flange positioned to be engaged by the cover. The chime assembly further comprises a bottom flange comprising an annular lower side wall, an annular radially-inwardly extending support surface, and a downwardly-projecting annular glide ring to contact a support surface and thereby elevate the drum from the ground surface. The chime assembly is preferably entirely plastic.

17 Claims, 6 Drawing Sheets

FIBER BOARD DRUM WITH PLASTIC CHIME ASSEMBLY

BACKGROUND

The present invention relates to fiber board drum structures and, more particularly, to top and bottom chime assemblies for fiber board drum structures.

Fiber board drums are commonly utilized to store and ship a variety of materials. When such materials are placed in a drum for shipping or storage, it is useful to have a means for securely attaching a top to the drum to seal it and retain its contents. Galvanized steel chimes are known and are fitted on top of a fiber board drum to accept a cover to thereby seal the drum. Top steel chimes are usually annular rings having a profile shaped to receive a cover and a closing ring. Steel chimes are shaped to be mounted on the upper open end of the drum.

It is also often desired to elevate fiber board drums off of the floor or a support surface to keep the drum bottom out of contact with water or contaminants and steel bottom chimes often are used for this purpose. However, the use of steel top and bottom chimes in fiber board drums can lead to several problems. Steel chime assemblies—even when galvanized—are subject to rusting, which reduces the integrity of the seal. Steel chimes also may experience corrosion and weakening due to reaction between the steel and the product within the drum. Corrosion, like rusting, can degrade the seal between the chime and the cover, which ultimately may cause contamination of the product.

Metal chimes also may have sharp edges or burrs that may pose a safety hazard to personnel during handling of the drums. Additionally, metal chimes are not easily disposed of. Although the fiber board material of the drums may be easily incinerated or recycled, disposing of the metal chimes requires an additional procedure after incineration. Finally, metal chimes are not satisfactorily impact-resistant. Forces imparted upon a metal chime assembly during handling or transit may result in denting and bending of the assembly.

It is also known in the art to utilize metal chimes that are coated with a plastic overlay to resist corrosion and rusting. However, such chime assemblies tend to be prohibitively expensive to fabricate, and any nick or break in the plastic coating would result in corrosion or rusting of the metal.

Accordingly, there exists a need for a chime assembly for use with a drum that resists rust and corrosion, provides smooth edges, can be incinerated without leaving residual waste, and effectively resists impacts.

SUMMARY OF THE INVENTION

The present invention is a plastic chime assembly for a fiber board drum that is impervious to rust, resists corrosion, provides smooth edges for safer handling, is combustive for easy disposal, and resists deformation upon impact.

In particular, the plastic chime assembly of the present invention provides for a top chime shaped to mount on the mouth of a fiber drum and to receive a cover and a closing ring. The present invention also includes a bottom chime to elevate the drum above the floor or support surface, and to fit into an associated cover to provide for stackability of drums. The bottom chime is shaped to interlock with an associated cover of a drum on which it is stacked. In this manner drums utilizing the chime assembly of the present invention may be stacked in vertical columns, thereby allowing for convenient storage and reducing the requisite floor space for a given number of drums.

The chime assembly of the present invention utilizes a top chime having a profile that provides sufficient strength to enable it to be manufactured of plastic without requiring any metal reinforcing components. The chime assembly is simple to manufacture, requiring relatively little materials and few manufacturing steps to produce. Furthermore, a fiberboard drum may be prepared for receiving a cover and closing ring in the single step of mounting the top chime of the present invention to the drum.

Because the chime assembly is preferably manufactured from plastic, it will not rust or corrode in its preferred form, and thus the present invention resists deterioration due to reactions with the contained materials. In its preferred form the invention it is completely incinerable, and is easily disposed of with no residual waste. In addition, plastic has smooth edges, and generally does not form sharp edges or burrs.

In a preferred embodiment of the chime assembly of the present invention, a top chime comprises a lower band having a slot shaped to receive the upper opening of a cylindrical fiber board drum, and an upper annular portion shaped to receive a cover. The upper portion includes an annular groove shaped to receive a sealing ring for fixing a cover to the top chime, and a top flange having a substantially axially-extending wall and a substantially radially extending flange positioned to be engaged by the cover.

The chime assembly of the present invention further comprises a bottom chime having an annular lower side wall shaped to receive and overlap a bottom portion of the fiber drum shell, an annular, radially-inwardly extending support surface shaped to support the fiberboard bottom and located adjacent to the drum lower side wall, and a downwardly-projecting annular glide ring attached to the support surface.

Accordingly, it is an object of the present invention to provide a plastic chime assembly comprising a top chime shaped to fit on the upper opening of a drum to receive a cover and a closing ring, and a bottom chime for elevating the drum above the ground surface, wherein the chime assembly is impervious to rust, resists corrosion, provides smooth edges for safer handling, is combustive for easy disposal, resists deformation upon impact, and is relatively easy to manufacture and install.

Other objects and advantages of the present invention will be apparent from the following description, the accompanying drawings and the appended claims.

DETAILED DESCRIPTION

Figure 1:
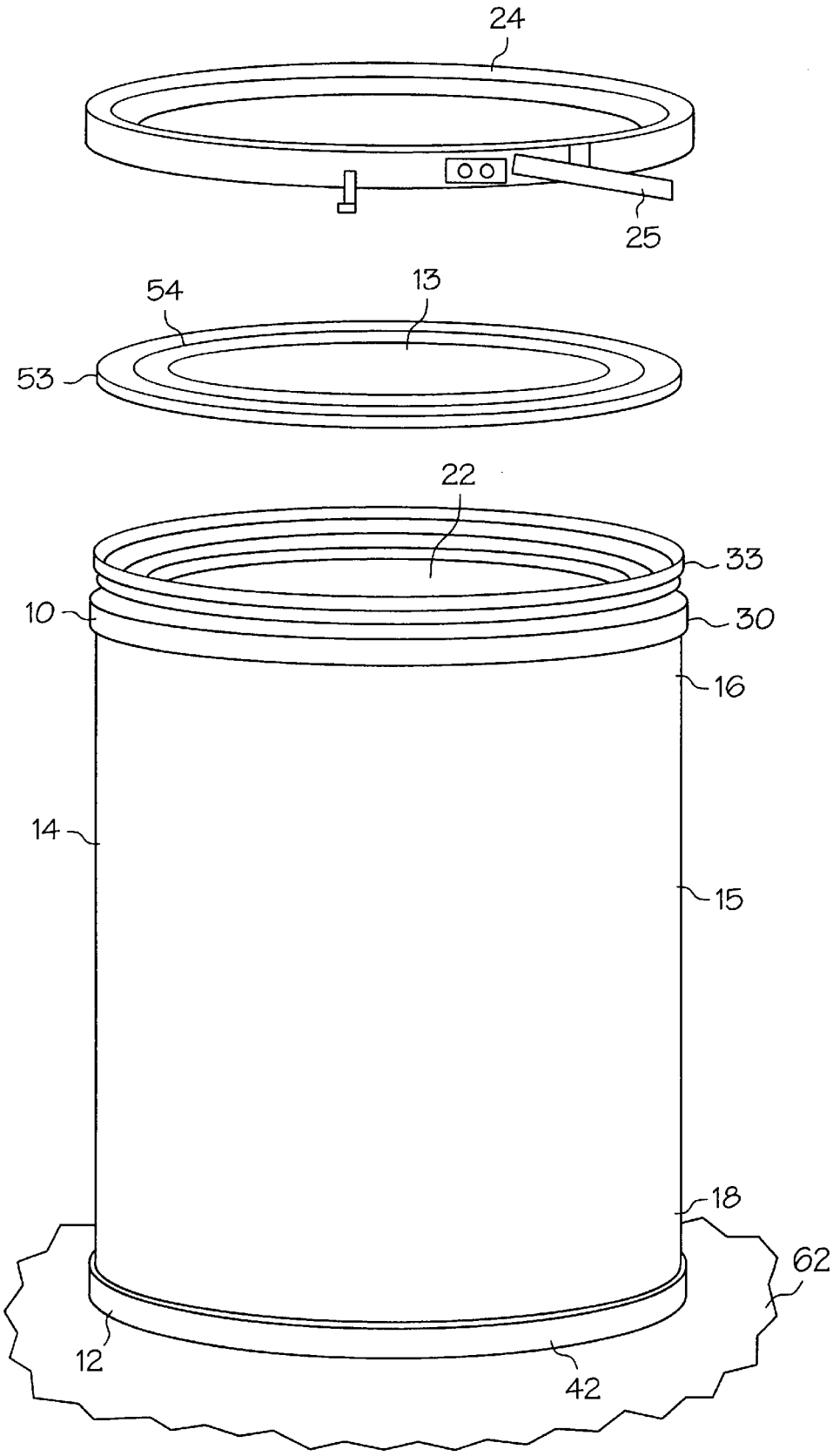
FIG. 1 is a perspective, exploded view of a preferred embodiment of the plastic chime assembly of the present invention.
Figure 2:
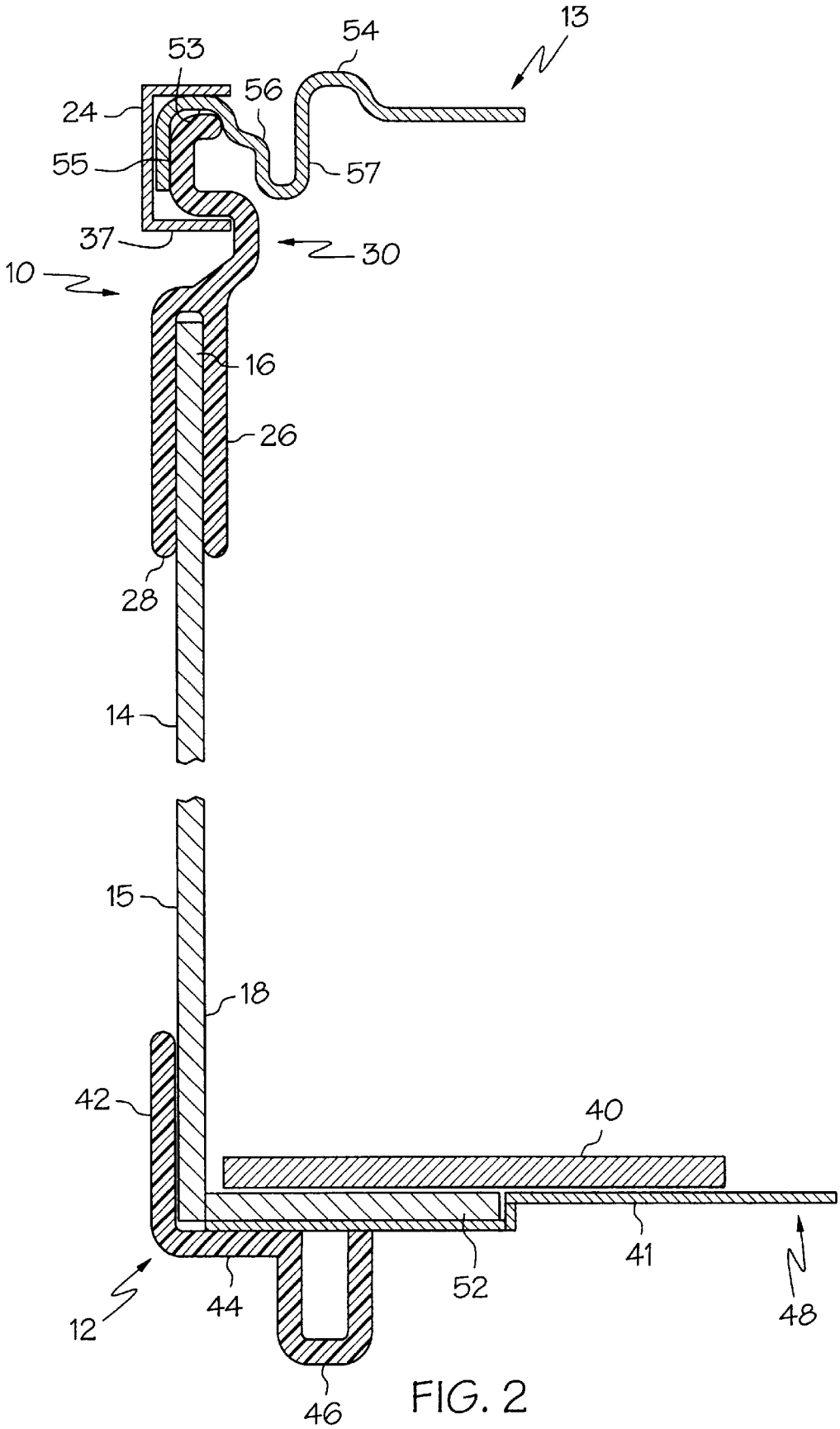
FIG. 2 is a detail showing side elevation in section of the plastic chime assembly and associated drum, cover, and closing ring of FIG. 1.
Figure 3:
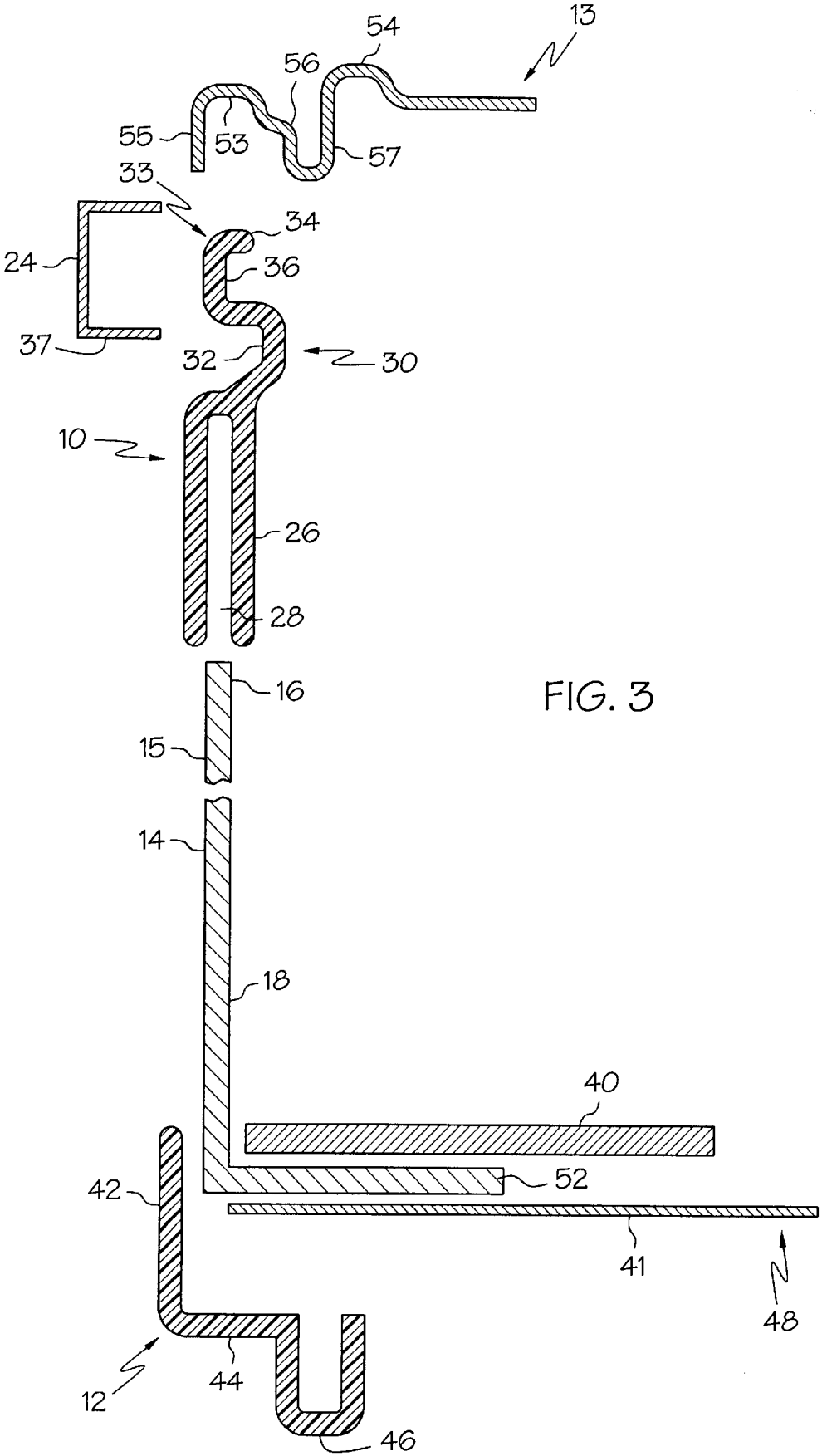
FIG. 3 is a detail showing in sections an exploded view of the plastic chime assembly and associated drum, cover, and closing ring of FIG. 2.

As shown in FIGS. 1–3, a preferred embodiment of the chime assembly of the present invention includes a top chime, generally designated 10, and a bottom chime, generally designated 12. The top chime 10 and bottom chime 12 are preferably used in conjunction with a cylindrical fiberboard drum 14 having a side wall 15 and a bottom assembly 48. Side wall 15 has an upper open end 16 and a lower closed end 18. The upper perimeter of the open end 16 defines an opening 22. Plastic top chime 10 is shaped to receive open end 16, and bottom chime 12 is shaped to receive closed end 18 and bottom assembly 48. When so affixed, bottom chime 12 may rest upon floor surface 62 when the drum is vertically oriented.

In order to close the top 16 of the fiberboard drum 14, a cover 13 may be placed over the opening 22. The cover 13 can be manufactured from a variety of materials, including plastic, metal and fiber and can be made entirely of each of such materials. As best shown in FIGS. 2 and 3, the cover 13 preferably has an annular, downwardly-opening seal notch 53 about its outer perimeter, and axially extending annular top hump 54 radially inwardly of the seal notch 53. The seal notch 53 includes an outer, downwardly-extending ring 55 which overlaps the top chime 10. Channel 57 is formed between the seal notch 53 and the top hump 54. The channel 57 has a radially inwardly extending cover notch 56 located in said channel.

The cover 13 is received and retained on the top chime 10 of the present invention by a closing ring 24. The plastic top chime 10 is preferably shaped to receive closing ring 24 as an additional means of securing the cover 13 to the plastic top chime 10. As shown in FIG. 1, closing ring 24 is U-shaped in section and encircles the cover 13. The ring 24 is locked into position by an overcenter lock 25, thereby securing the cover 13 to the top chime 10. Closing ring 24 may be manufactured from various materials, including metal and plastic.

Figure 5A:
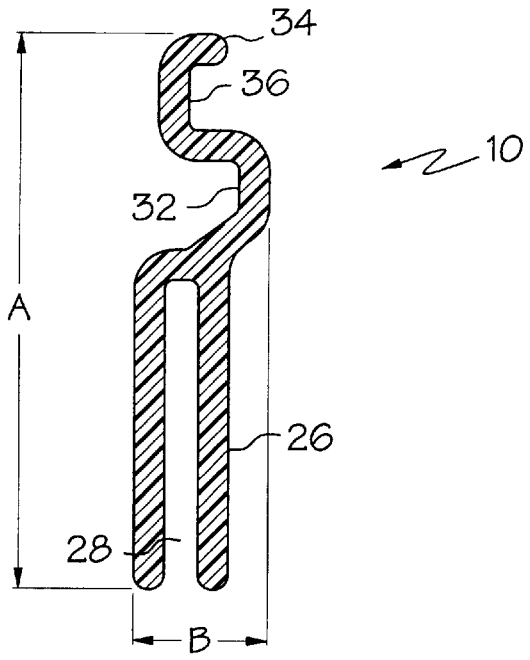
FIGS. 5A and 5B are details showing side elevations in section of the top and bottom chimes, respectively, of the assembly of FIG. 1.

As shown in FIGS. 2 and 3, the top chime 10 of the present invention comprises a lower band 26 and a upper annular portion 30. As shown in FIG. 5A, top chime 10 has a height, represented by the dimension A, and a width represented by the dimension B. Lower band 26 has a slot 28 for receiving open end 16.

As shown in FIG. 3, the upper annular portion 30 has an annular groove 32 and a top ring 33. The top ring 33 comprises an axially extending wall 36 and a substantially radially extending flange 34. The annular groove 32 is shaped to receive the lower leg 37 of the closing ring 24. The axially extending wall 36 and radially extending flange 34 are shaped to receive the cover 13 and the closing ring 24.

In operation, the top chime 10 is slid onto the top of the side wall 15 of the drum 14, with slot 28 receiving the open end 16. Various methods, including the use of adhesives, stapling, staking, riveting, stitching, sewing, bonding, and interference fitting, as well as other methods, may be utilized to retain the top chime 10 onto the open end 16 without departing from the scope of the invention. Once top chime 10 is mounted on the drum 14, it receives the seal notch 53 of the cover 13 as well as the closing ring 24, if desired. Thus, only a single step is required to prepare the fiberboard drum 14 for receiving a cover 13 and a closing ring 24. The top chime 10 may be adapted to receive the open section 16 of fiber drums of various shapes. Drums generally cylindrical in shape are preferred, but square, elliptical or other shapes in plan view may be used.

The bottom assembly 48 of the fiberboard drum 14 includes a disk-shaped base surface 40, an annular ridge surface 52, which is a continuation of the side wall 15, and a disk-shaped kraft surface sheet 41. Ridge surface 52 is a ring-like surface extending around the outer perimeter of the bottom assembly 48, and extending downwardly of the base surface 40. Kraft surface sheet 41 is located to cover the base surface 40 and the ridge surface 52 to provide a substantially uniform bottom surface.

Figure 5B:
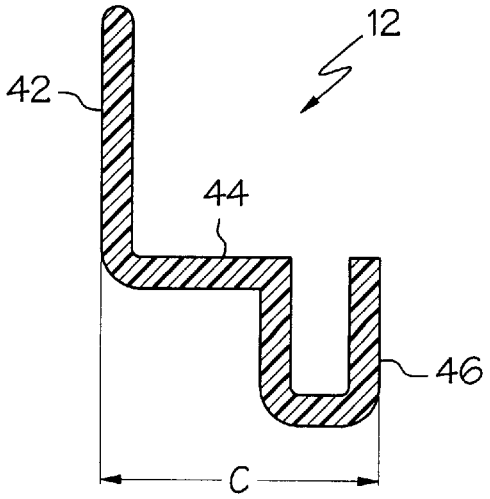

As shown in FIGS. 2, 3 and 5B, bottom chime 12 comprises a lower side wall 42, a support surface 44, and a glide ring 46. Bottom chime 12 has a total width represented by the dimension C, as shown in FIG. 5. The lower side wall 42 is an annular wall shaped to receive and overlap a portion of the closed end 18 adjacent to the ridge surface 52. The support surface 44 is a radially extending annular surface adjacent to the closed end 18, and is shaped to support the ridge surface 52.

The bottom chime 12 further comprises a glide ring 46, which is a downwardly projecting annular ring attached to the support surface 44. The glide ring 46 is shaped to contact the floor surface 62 to elevate the bottom assembly 48 of the drum 14 from the floor surface 62. In this manner, the bottom assembly 48 is prevented from coming in contact with moisture or other contaminants that may be present on the floor surface 62 which might otherwise seep through the bottom assembly 48 to weaken it or to contaminate the goods. The bottom chime 12 may be attached to the closed end 18 and bottom assembly 48 by various means, including adhesives, stapling, staking, riveting, stitching, sewing, bonding, and interference fitting, and other means, without departing from the scope of the invention.

Figure 6:
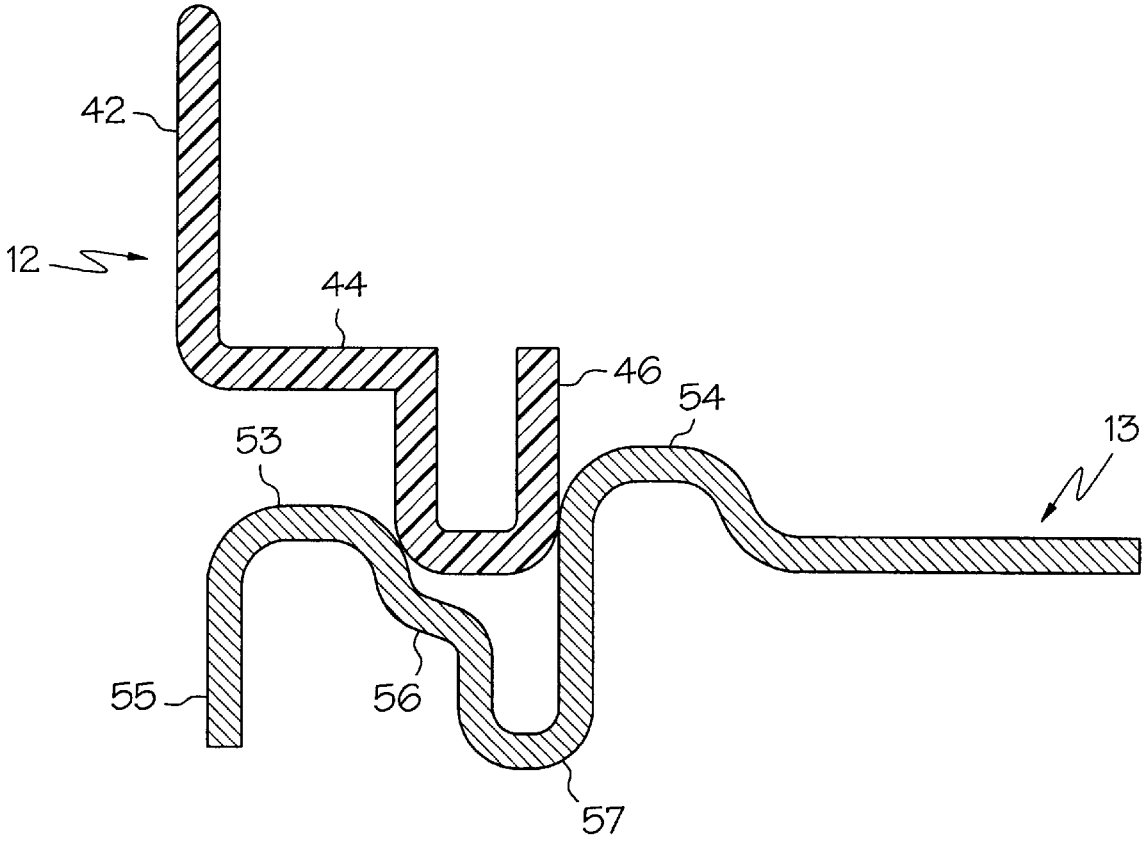
FIG. 6 is a detail showing side elevations in section of the bottom chime and cover of FIG. 1, shown in interlocking stacking position.

The glide ring 46 serves the additional purpose of making the bottom chime 12, and therefore the associated drum, stackable. As shown in FIG. 6, the ring 46 is sized to rest in the channel 57 of the cover 13 and sits on the cover notch 56. In this manner, the channel 57 may receive the glide ring 46 in order to enable stacking of the assembled fiberboard drums 14. The glide ring 46 interlocks with the channel 57 of the cover 13 so that drums 14 can be stacked in a stable manner.

Figure 4:
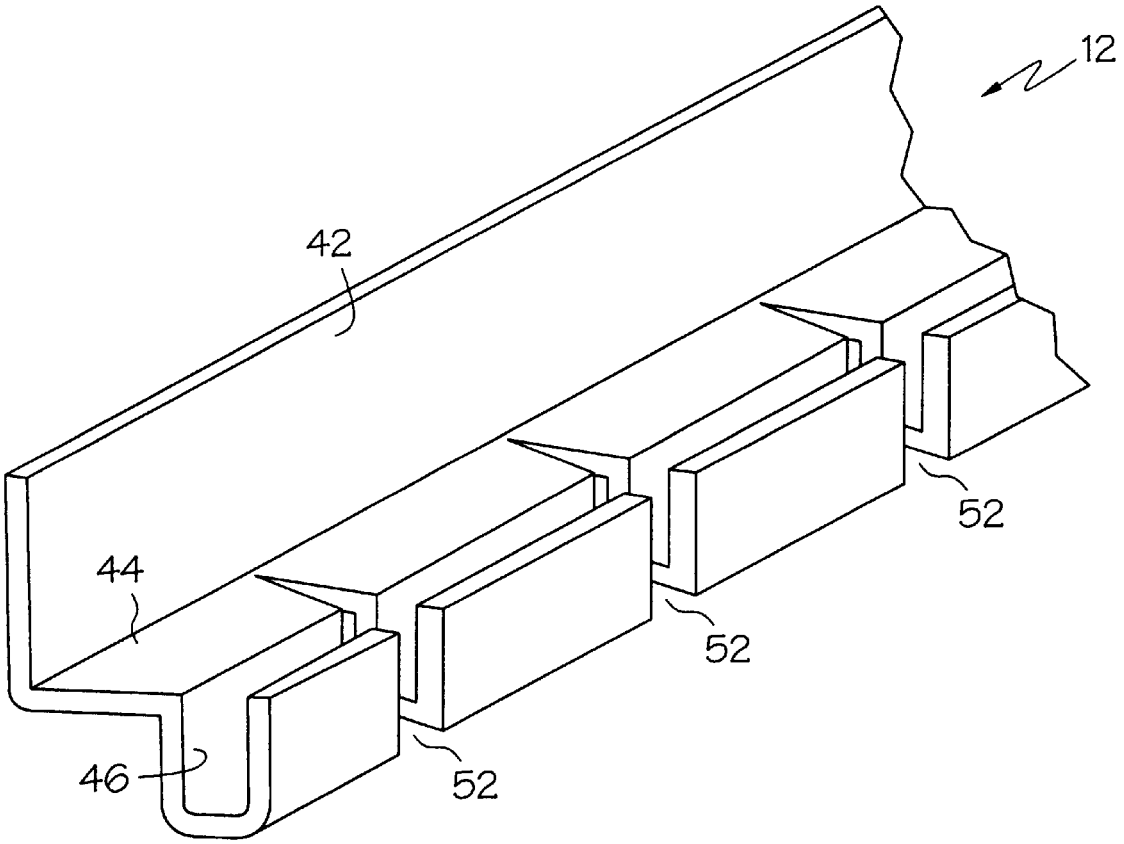
FIG. 4 is a detail showing perspective view of a preferred embodiment of a bottom chime of the present invention, shown unassembled.

The plastic chime assembly of the present invention may be manufactured from a variety of materials and plastics, with a high density polyethylene or polypropylene being preferred. The chime assembly of the present invention is preferably manufactured by injection molding or extrusion of the chime cross section. The top and bottom chimes may be cut to length to match the perimeter of a given drum. When formed by extrusion, the two ends of each chime are butt-welded together to form a closed circle or other appropriate shape. Various diameters and shapes of drums can be accommodated by simply modifying the length or shape in elevation or length of each chime. When the bottom chime 12 is formed by extrusion, due to its relative rigidity it may require a plurality of V-shaped notches 52 to facilitate its being formed into a closed loop, which is then butt welded. If the chime 12 is formed by injection molding, no notching or welding will be necessary. FIG. 4 illustrates a bottom chime 12 formed by extrusion and having a plurality of cutouts 52.

While the forms of apparatus herein described constitute a preferred embodiment of the invention, it is to be understood that the present invention is not limited to these precise forms and that changes may be made therein without departing from the scope of the invention.

What is claimed is:

1. A fiber board drum comprising:

a substantially cylindrical fiber drum shell having a bottom and a side wall extending upwardly from said bottom and defining an upper opening; and a chime attached about said upper opening and having:

a lower band at a lower end thereof, said lower band having a downwardly-opening slot receiving an upper end of said side wall therein in a fixed manner to prevent relative movement between said chime and said side wall, an upper portion positioned above and unitary with said lower band, said upper portion including an annular groove positioned above said downwardly-opening slot and recessed to receive a lower leg of a closing ring therein, an axially extending wall extending upwardly from said annular groove and a top flange extending radially inwardly from an upper end of said axially extending wall, said axially extending wall and said radially extending flange being shaped to receive a cover, and wherein said chime is made entirely of plastic material.

2. The fiber board drum of claim 1 further comprising:

a bottom chime, said bottom chime having:

a lower side wall extending around a lower portion of said lower side wall of said fiber board drum shell;

an annular support surface extending radially inward from said side wall;

an annular glide ring extending downwardly from said support surface; and said bottom chime is made entirely of plastic.

3. A fiber board drum comprising:

a substantially cylindrical fiber drum shell having a bottom, a ridge portion extending around an inner perimeter of said bottom, and a side wall extending upwardly from said ridge portion and defining an upper opening; and a top chime having a lower band at a lower end thereof, said lower band having a downwardly-opening slot receiving an upper end of said side wall therein, an upper annular portion, positioned above and unitary with said lower band, shaped to receive a cover thereon, said upper portion including an annular groove adjacent and connected to said downwardly-opening slot and shaped to receive a lower leg of a closing ring therein, an axially extending wall extending upwardly from said annular groove and a top flange extending radially inwardly from an upper end of said axially extending wall, said axially extending wall and said radially extending flange being shaped to receive said cover, and wherein said top chime is made entirely of plastic material.

4. The fiber board drum of claim 3 further comprising a bottom chime, said bottom chime comprising:

a lower side wall extending around said side wall of said drum shell adjacent to said ridge portion of said dram shell;

an annular, radially inwardly extending support surface extending from said lower side wall of said bottom chime and shaped to support said ridge portion of said drum shell;

a downwardly-projecting annular glide ring attached to said support surface; and said bottom chime is made of plastic.

5. The fiber board drum of claim 4 wherein said lower side wall, support surface and glide ring are unitary in construction.

6. The fiber board drum of claim 4 wherein said top and bottom chimes each have a cross section, said top and bottom chimes each being formed by extrusion of said cross section of each of said top and bottom chimes.

7. The fiber board drum of claim 6 wherein said top and bottom chimes each are formed into a closed loop by butt welding.

8. The fiber board drum of claim 7 wherein said top and bottom chime each are attached to said drum by affixing means.

9. The fiber board drum of claim 8 wherein said affixing means includes adhesives.

10. The fiber board drum of claim 9 wherein said top chime and bottom chime are substantially circular in plan view.

11. The fiber board drum of claim 4 wherein said top and bottom chimes each are formed by injection molding.

12. A method of producing a fiber board drum comprising the steps of:

selecting a substantially cylindrical fiber drum shell having a bottom, a ridge portion extending around an inner perimeter of said bottom, and a side wall extending upwardly from said ridge portion and defining an upper opening; and forming an upper chime having a lower band at a lower end thereof, said lower band having a downwardly-opening slot and attaching said upper chime by inserting an upper end of said side wall into said slot, said forming step also including forming said upper chime to have an upper portion unitary with and positioned above said lower band, said upper portion shaped to receive a cover thereon, said upper portion including an annular groove extending about a radially outer side of said annular portion and above said downwardly-opening slot and shaped to receive a lower leg of a closing ring therein, an axially extending wall extending upwardly from said annular groove and a top flange extending radially inwardly from an upper end of said axially extending wall, said axially extending wall and said radially extending flange being shaped to receive said cover, and wherein said upper chime is made entirely of plastic material.

13. The method of claim 12 further comprising the steps of:

forming a bottom chime, said bottom chime comprising an annular lower side wall shaped to receive and overlap a portion of said side wall adjacent to said ridge portion, an annular, radially inwardly extending support surface adjacent to said side wall and shaped to support said ridge portion, and a downwardly-projecting annular glide ring attached to said support surface, wherein said bottom chime is made of plastic material; and attaching said bottom chime to said fiber drum bottom around said side wall.

14. The method of claim 13 wherein said bottom chime forming step includes forming said lower side wall, support surface and glide ring as a unitary construction.

15. The method of claim 13 wherein in each of said forming steps said upper and bottom chime are formed into a closed loop by butt welding.

16. The method of claim 15 wherein each of said attaching steps includes attaching said upper chime and said bottom chime by adhesives.

17. The method of claim 13 wherein said forming steps each include forming by injection molding.

* * * * *